US006832062B2

(12) United States Patent
Ishiyama et al.

(10) Patent No.: US 6,832,062 B2
(45) Date of Patent: Dec. 14, 2004

(54) CHARGING APPARATUS, PROCESS CARTRIDGE AND IMAGE FORMING APPARATUS HAVING ELECTROCONDUCTIVE PARTICLES CHARGED IN A NIP BETWEEN A CHARGING MEMBER AND A MEMBER TO BE CHARGED

(75) Inventors: Harumi Ishiyama, Numazu (JP); Yasunori Chigono, Susono (JP); Jun Hirabayashi, Numazu (JP); Norio Takahashi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 46 days.

(21) Appl. No.: 10/357,228

(22) Filed: Feb. 4, 2003

(65) Prior Publication Data

US 2003/0180073 A1 Sep. 25, 2003

(30) Foreign Application Priority Data

Feb. 5, 2002 (JP) ..... 2002/027969
Jan. 30, 2003 (JP) ..... 2003/021656

(51) Int. Cl.[7] ..... G03G 15/02
(52) U.S. Cl. ..... 399/175
(58) Field of Search ..... 399/100, 149, 399/150, 174, 175, 176

(56) References Cited

U.S. PATENT DOCUMENTS 5,579,095 A 11/1996 Yano et al.
5,754,927 A 5/1998 Ishiyama et al. ..... 399/176
5,822,659 A 10/1998 Ishiyama ..... 399/175
6,038,420 A 3/2000 Hirabayashi et al. ..... 399/176
6,081,681 A 6/2000 Nagase et al. ..... 399/174
6,128,456 A 10/2000 Chigono et al. ..... 399/176
6,134,407 A 10/2000 Ishiyama et al. ..... 399/174
6,163,671 A * 12/2000 Ishiyama et al. ..... 399/176
6,289,190 B1 9/2001 Amamiya et al. ..... 399/174
6,519,433 B1 * 2/2003 Hirabayashi et al. ..... 399/174
2002/0106216 A1 8/2002 Ishiyama et al. ..... 399/175
2002/0197082 A1 12/2002 Hosokawa et al. ..... 399/176
2003/0002888 A1 1/2003 Ishiyama et al. ..... 399/175

FOREIGN PATENT DOCUMENTS

EP 0 864 936 9/1998
EP 1 091 261 4/2001

* cited by examiner

*Primary Examiner*—William J. Royer
(74) *Attorney, Agent, or Firm*—Fitzpatrick, Cella, Harper & Scinto

(57) ABSTRACT

A charging apparatus includes a charging member for charging a member to be charged while forming a nip with the member to be charged, and electroconductive particles disposed in the nip. The charging member is supplied with a voltage of a certain polarity, a surface of the member to be charged is triboelectrically charged by a surface of the charging member so as to have a polarity opposite from that of the voltage, and the electroconductive particles are triboelectrically charged in the nip so as to have a polarity opposite from that of the voltage.

26 Claims, 3 Drawing Sheets

CHARGING APPARATUS, PROCESS CARTRIDGE AND IMAGE FORMING APPARATUS HAVING ELECTROCONDUCTIVE PARTICLES CHARGED IN A NIP BETWEEN A CHARGING MEMBER AND A MEMBER TO BE CHARGED

FIELD OF THE INVENTION AND RELATED ART

The present invention relates to a charging apparatus including a charging member for charging a member to be charged, such as a photosensitive member or a dielectric body, while forming facilitator particles. The present invention also relates to a process cartridge and an image forming apparatus, such as an electrophotographic apparatus or an electrostatic recording apparatus, which includes the charging apparatus.

A contact-type charging apparatus using electroconductive particles has been disclosed, e.g., in U.S. Pat. Nos. 6,081,681; 6,128,456: and 6,134,407.

In this charging apparatus, a member to be charged is caused to contact a charging member generally comprising an electroconductive elastic foam roller with a speed difference therebetween at a charge-contact portion (charging nip) where electroconductive particles are disposed at least in contact with both the member to be charged and the charging member, while applying a charging bias to the charging member. As a result, a direct charge-injection mechanism is dominant rather than an electrical discharge-based charging mechanism.

(1) Electrical Discharge-based Charging Mechanism

This charging mechanism is a mechanism in which the surface of a member to be charged is charged by electrical discharge which occurs across a microscopic gap between a contact-type charging member and the member to be charged.

In the case of the electrical discharge-based charging mechanism, a certain discharge threshold is present between the contact-type charging member and the member to be charged, thus requiring application of a voltage to the contact-type charging member with a value larger than a charging potential therefor. Further, in principle, it is impossible to avoid generating by-products of electrical discharge, although the amount thereof is considerably small in comparison with the case of a non-contact-type charging apparatus, such as a corona discharger. Accordingly, the contact-type charging member cannot completely eliminate the problems caused by active ions, such as ionized ozone.

For example, a roller-charging scheme using an electroconductive roller (charging roller) as the contact-type charging member is preferred in terms of stability and is used widely, but in this roller-charging scheme, the electrical discharge-based charging mechanism is dominant in this charging scheme.

(2) Direct Charge-injection Mechanism

This is a mechanism in which the surface of a member to be charged is charged by direct injection of electrical charge from a contact-type charging member to the member to be charged. More specifically, a contact-type charging member with medium electrical resistance is placed in contact with the surface of a member to be charged to directly inject electrical charge into the surface portion of the member to be charged, without relying on an electrical-discharge phenomenon, i.e., without principally using an electrical-discharge mechanism. Therefore, even if the value of the voltage applied to the contact-type charging member is below the discharge-threshold value, the member to be charged can be charged to a voltage level which is substantially the same as the level of the voltage applied to the contact-type charging member. This direct injection-charging mechanism does not suffer from the problems caused by the by-product of electrical discharge since it is not accompanied by the occurrence of ions.

As described above, in the contact-type charging apparatus using electroconductive particles, the direct charge-injection mechanism is dominant. The electroconductive particles are particles for charge facilitation. As the electroconductive particles, it is possible to use various electroconductive particles including electroconductive fine particles of metal oxide, such as zinc oxide, other inorganic fine particles, mixtures thereof with an organic compound, or the like.

By the presence of the electroconductive particles, the contact-type charging member can be in contact with the member to be charged at a contact-charge portion therebetween with a difference in speed with the member to be charged. At the same time, the charging member intimately contacts the member to be charged via the electroconductive particles. In other words, the electroconductive particles present at the contact-charge portion are frictionally disposed in close contact with the surface of the member to be charged, thus effecting direct injection of electrical charge into the member to be charged. That is, charging of the member to be charged by the contact-type charging member supplied with a charging bias can make the direct charge-injection mechanism dominant.

As a result, in the direct charge-injection mechanism, it is possible to obtain a high charge efficiency that has not been attained by the aforementioned roller charging, and so forth. Further, it is possible to impart an electrical potential substantially equal to a voltage applied to the member to be charged, thus realizing ozone-less direct charge injection with a simple structure at a low applied voltage. As an embodiment, in an electrophotographic image forming apparatus or an electrostatic recording-type image forming apparatus, the contact-type charging member is effective as charging means for uniformly charging an image bearing member, such as an electrophotographic photosensitive member or an electrostatic recording dielectric member, to a predetermined polarity and potential level through direct charge injection.

Further, in recent years, an image forming apparatus is increasingly required to be a cleanerless system producing no waste toner from an ecological standpoint. In the aforementioned direct charge-injection mechanism using electroconductive particles, it is possible to effect uniform charging by the use of a cleanerless apparatus.

In a specific embodiment, electroconductive particles are mixed with a developer and at a developing position, are supplied together with a toner from a developing apparatus to the surface of an image bearing member, such as an electrophotographic photosensitive member, as a member to be charged. At a transfer position, only the toner is principally transferred onto a transfer medium and, the electroconductive particles are supplied to the charge-contact portion, thus allowing uniform charging based on injection charging in the cleanerless apparatus.

However, in such a direct charge-injection mechanism using electroconductive particles, the following problem arises.

More specifically, electroconductive particles on the contact-type charging member are gradually detached therefrom to the surface of the member to be charged. In the aforementioned cleanerless image forming apparatus, even if the contact-type charging member is replenished with electroconductive particles from the developing apparatus via the image bearing member surface to maintain a direct charge-injection state, with the use of the image forming apparatus, the detachment amount of electroconductive particles detaching from the surface of the contact-type charging member and the replenishing amount of electroconductive particles replenished from the developing apparatus to the contact-type charging member via the image bearing member surface become out of balance, thus resulting in an insufficient amount of electroconductive particles required for adequate charging on the contact-type charging member in some cases. In such cases, the charging performance is lowered to cause image failure in an image forming apparatus. This phenomenon is liable to occur by the use of the cleanerless image forming apparatus for a long period.

SUMMARY OF THE INVENTION

An object of the present invention is to provide a charging apparatus, a process cartridge and an image forming apparatus, in which electroconductive particles are liable to remain on a charging member.

Another object of the present invention is to provide a charging apparatus, a process cartridge and an image forming apparatus, which are capable of suppressing movement of electroconductive particles from a charging member to a member to be charged.

Another object of the present invention is to provide a charging apparatus, a process cartridge and an image forming apparatus, which are capable of providing a stable charging performance of a charging member against a member to be charged.

Another object of the present invention is to provide a charging apparatus, a process cartridge and an image forming apparatus, which are suitable for the use of a cleanerless scheme which is liable to cause a soiled state of a charging member with a transfer residual toner as a charge-inhibition factor.

According to the present invention, there is provided a charging apparatus comprising:

a charging member for charging a member to be charged while forming a nip with the member to be charged, and electroconductive particles disposed in the nip, wherein the charging member is supplied with a voltage of a certain polarity, a surface of the member to be charged is triboelectrically charged by a surface of the charging member so as to have a polarity opposite from that of the voltage supplied to the charging member, and the electroconductive particles are triboelectrically charged in the nip so as to have a polarity opposite from that of the voltage.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
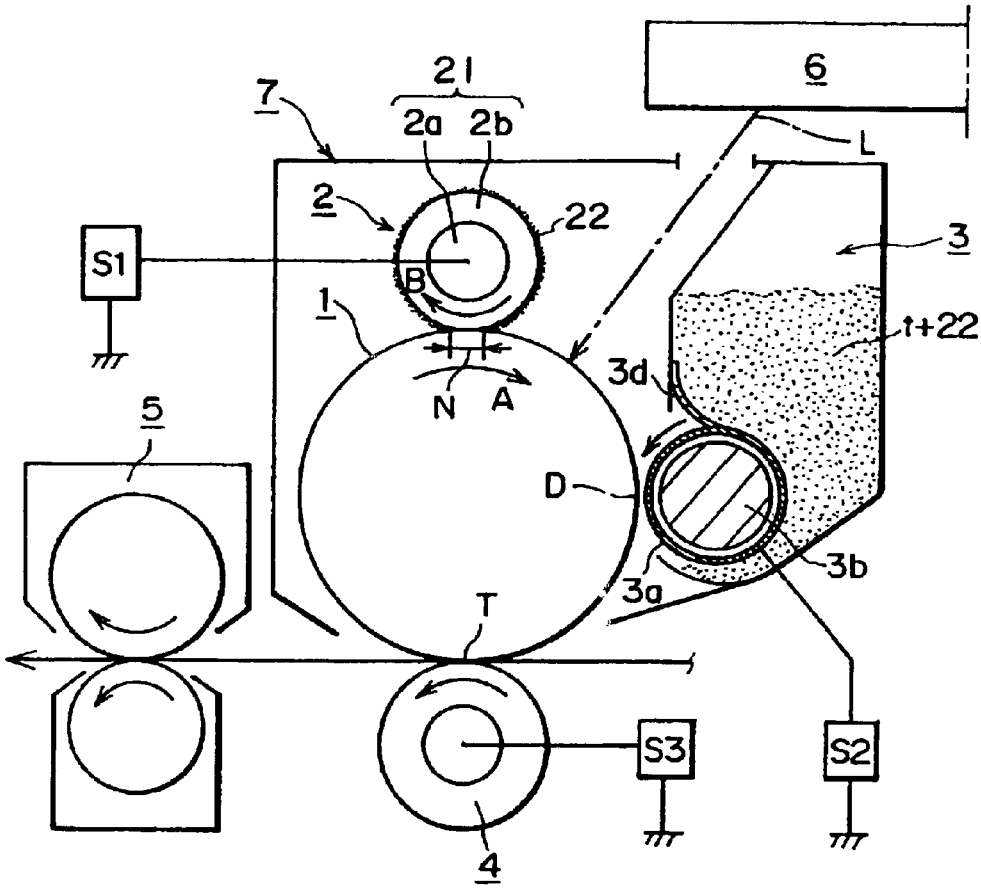
FIG. 1 is a schematic section of the image forming apparatus according to the present invention.

FIG. 1 is a schematic sectional view of an example image forming apparatus including a charging apparatus in accordance with the present invention, and depicts the general structure of the image forming apparatus.

The image forming apparatus in this embodiment employs: an electrophotographic process utilizing a transfer scheme, a direct charge-injection scheme using electroconductive particles, a reversal development scheme, a cleanerless system (toner recycling process), and a laser beam printer (recording apparatus) using a detachably mounted cartridge.

(1) Schematic Explanation of General Structure of a Printer

Referring to FIG. 1, a reference numeral 1 designates a rotation drum-type electrophotographic photosensitive member as an image bearing member (member to be charged) (herein, referred to as a "photosensitive drum"). This photosensitive drum is cylindrical and has a diameter of 30 mm, and is rotatably driven in a clockwise direction of an arrow shown in FIG. 1 at a constant peripheral speed of 50 mm/sec.

Figure 2:
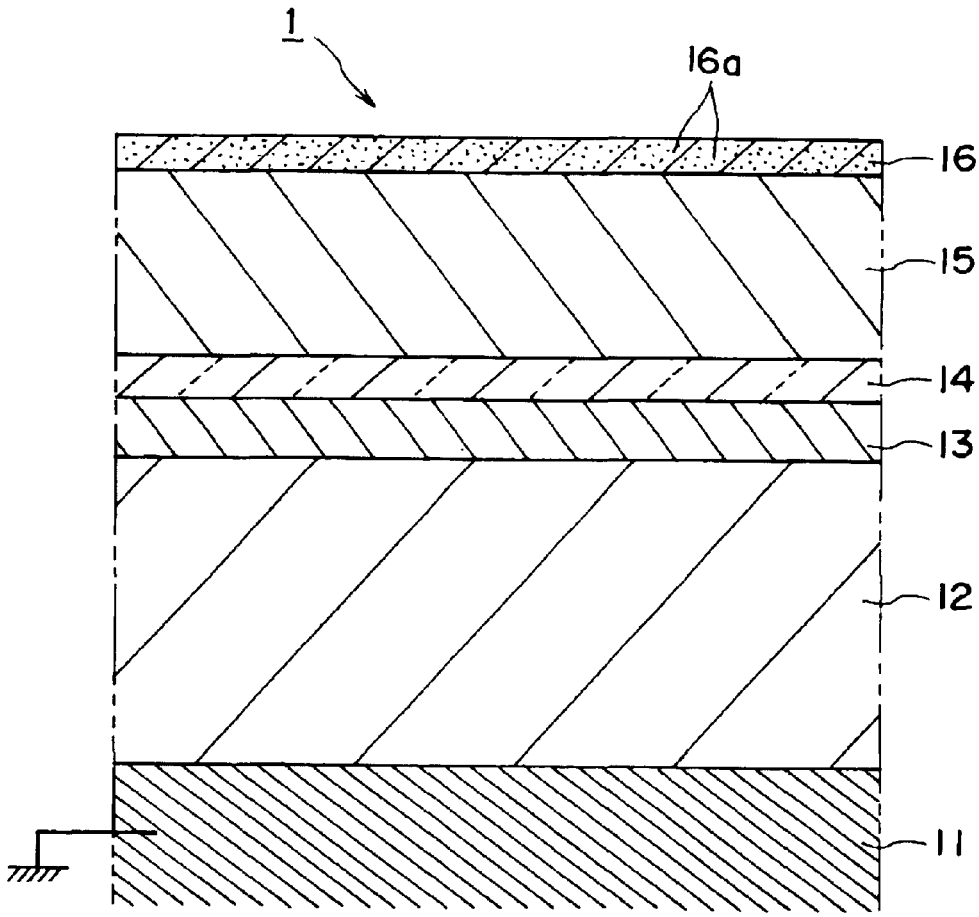
FIG. 2 is a schematic section of a laminar structure of a photosensitive drum.

FIG. 2 is an enlarged schematic section of a portion of the photosensitive drum 1 employed in this embodiment, and depicts the laminar structure of the photosensitive drum 1. The photosensitive drum 1 is formed by coating a charge-injection layer 16 on the peripheral surface of an ordinary photosensitive drum 1, which is constituted of an aluminum drum support 11 (base member), and various layers: an undercoat layer 12, a positive charge-injection-prevention layer 13, a charge-generation layer 14, and a charge-transfer layer 15, which are coated on the aluminum drum support 11 in this order from the bottom. The charge-injection layer 16 is coated to improve the photosensitive drum 1 in terms of charging performance (chargeability).

The charge injection layer 16 is formed by mixedly dispersing $SnO_2$ ultramicroscopic particles 16*a* (approximately 0.03 $\mu$m in diameter) and a lubricant such as tetrafluoroethylene (Teflon) in a thermosetting phenolic resin and curing the dispersion. The resin is a resol-type phenolic resin with the use of an amine compound catalyst. The curing of the resin is performed by hot-air drying at 145° C. for 1 hour.

The most important property of the charge-injection layer 16 is its electrical resistance. In the case of a scheme for charging a member to be charged by directly injecting charge thereinto, the efficiency with which the member to be charged is charged is improved by reducing the electrical resistance on the side of the member to be charged. Further, when the member to be charged is a photosensitive drum, an electrostatic latent image must be retained for a certain period of time. Therefore, the charge-injection layer 16 may have an appropriate volume resistivity in the range of $1\times10^{9}$–$1\times10^{14}$ (ohm.cm).

A reference numeral 2 designates a charging apparatus (charger) for charging the peripheral surface of the photosensitive drum 1 to a predetermined polarity and a predetermined potential level. In this embodiment, the charging apparatus 2 is a contact-type charging apparatus using electroconductive particles 22. As a contact-type charging member for the charging apparatus 2, an electroconductive elastic foam roller 21 (hereinafter, referred to as a "charge roller") is used. The charge roller 21 is caused to contact the photosensitive drum 1 at a predetermined pressing force to form a charge-contact portion (a nip) N therebetween. At least at the charge-contact portion N, electroconductive particles 22 are disposed, and the charge roller 21 is rotated in a clockwise direction of an arrow B shown in FIG. 1, but in a counter direction relative to the rotation direction of the arrow A of the photoconductive drum 1. As a result, the charge roller 21 is placed in contact with the photosensitive drum 1 with a speed difference therebetween at the charge-contact portion N while applying a predetermined charging-bias voltage (negative charge polarity) from a charging-bias application-power source S1 to the charge roller 21, whereby the peripheral surface of the photosensitive drum 1 is uniformly charge-treated through the direct charge-injection mechanism so as to have a predetermined polarity and a predetermined potential level.

In this embodiment, the charge roller 21 and the photosensitive drum 1 are driven in directions opposite from each other at an equal peripheral speed of approximately 80 rpm in the charge-contact portion N while applying a DC voltage of −700 V to a roller metal core 2*a*, whereby the photosensitive drum surface is (negatively) charged to a potential level equal to the applied voltage.

The aforementioned charging apparatus 2 will be described in more detail in section (2) appearing hereinafter.

A reference numeral 6 designates an image-exposing device, as a latent image forming means, which is a laser-beam scanner in this embodiment. An image-forming portion of the uniformly charged surface of the photosensitive drum 1 is subjected to scanning exposure with a laser beam L depending on a print pattern, thus forming an electrostatic latent image on the peripheral surface of the photosensitive drum 1.

A reference numeral 3 designates a developing apparatus (device) for developing the electrostatic latent image into a toner image. In this embodiment, the developing apparatus 3 is a non-contact reversal-development-type apparatus which employs, as a developer, a negatively chargeable magnetic monocomponent toner (negatively chargeable toner) t.

The laser beam printer in this embodiment is designed to replenish the charge roller 21 as the contact-type charging member with the electroconductive particles 22 from the developing apparatus 3 via the peripheral surface of the photosensitive drum 1. The developer contained in the developing apparatus 3 comprises the magnetic monocomponent toner t and the electroconductive particles 22 mixed in a predetermined proportion.

The developing apparatus comprises a rotating developing sleeve 3*a* which encases therein a magnetic roller 3*b*, a regulation blade 3*d*, and a developing-bias application-power source S2 for applying a developing bias to the developing sleeve 3*a*.

In a step of carrying the toner t contained in the developing apparatus 3 on the developing sleeve 3*a*, the toner t is subjected to layer-thickness regulation and electric-charge importation (triboelectric charge), and introduced into a developing position D, where the electrostatic latent image formed on the photosensitive drum 1 is developed with the toner t in a reversal development operation. At the time of development, the electrostatic latent image is developed with the toner t while supplying the electroconductive particles 22, which are triboelectrically charged to a polarity (positive polarity) opposite from a normal charging polarity of the toner t.

A reference numeral 4 designates a transfer apparatus (transfer charger) which is a transfer roller in this embodiment.

The transfer roller 4 is pressed against the peripheral surface of the photosensitive drum 1 with a predetermined pressure to form a transfer-contact portion T, and rotated in a forward direction of the arrow shown in FIG. 1 inside roller 4 against the rotation of the photoconductive drum 1 at a peripheral speed substantially equal to that of the rotating photoconductive drum 1. A reference numeral S3 designates a transfer-bias application-power source, which applies to the transfer roller 4 a predetermined transfer bias of a polarity opposite to the charging polarity of the toner t at a predetermined control timing.

Into the transfer-contact portion T, a recording medium, which is delivered from an unillustrated sheet-feeder-mechanism portion, is fed and conveyed while being sandwiched between the transfer roller 4 and the photosensitive drum 1, whereby the toner image on the side of the photosensitive drum 1 is sequentially transferred electrostatically onto the surface of the recording medium.

After being passed through the transfer-contact portion T, the recording medium is separated from the peripheral surface of the photosensitive drum 1, and then is guided into a fixing apparatus (device) 5, in which the toner image is permanently fixed and discharged from the fixing apparatus 5 as a print or copy.

The printer in this embodiment is of a cleanerless type. The transfer residual toner retained on the peripheral surface of the photosensitive drum 1 after the recording medium is separated therefrom, is carried for toner recycling to the charge-contact portion N, which is a contact portion between the charge roller 21 and the photosensitive drum 1, with a subsequent rotation of the photosensitive drum 1. The transfer residual toner comprises positively charged particles and negatively charged particles in mixture, but is attached to or included into the surface portion of the charging roller 21 while being dislocated by minute projections on the peripheral surface of the charge roller 21. The toner t attached to the charge-roller surface is negatively charged in this embodiment by frictional (triboelectrical) charging with the photosensitive-drum surface or the electroconductive particles for charging. As a result, the toner t is gradually detached from the charge-roller surface and attached to the photosensitive-drum surface, and is then carried to the developing position D by a subsequent rotation of the photosensitive drum 1, followed by cleaning (recovery) performed in concurrence with development by the developing apparatus 3. Thus, the recovered toner is recycled.

This cleaning performed in concurrence with development is a process wherein the toner t remaining on the image bearing member 1 after image transfer is recovered by a fog-removal bias (the voltage-level difference Vback between the level of the DC voltage applied to a developing means (developing apparatus 3) and the level of the surface potential of an image bearing member (photosensitive drum 1) during development in a subsequent cycle, i.e., development after the image bearing member 1 is charged and a latent image is formed on the image bearing member 1.

In this embodiment, the electroconductive particles 22 mixed with the magnetic monocomponent toner t, functioning as the developer contained in the developing apparatus 3, is liable to exhibit a positive chargeability as an external additive. Accordingly, the electroconductive particles 22 alone are caused to jump from the developing sleeve 3*a* to a non-image forming portion corresponding to a dark-part potential portion of an electrostatic latent image on the peripheral surface of the photosensitive drum 1. Further, a part of the electroconductive particles 22 is attached to the toner t, thus jumping from the developing sleeve 3*a* to an image-forming portion corresponding to a light-part potential portion of the electrostatic latent image on the peripheral surface of the photosensitive drum 1.

These electroconductive particles 22 that jump to the peripheral surface of the photosensitive drum 1 are positively chargeable, thus remaining on the photosensitive-drum surface together with the transfer residual toner. With a subsequent rotation of the photosensitive drum 1, such electroconductive particles 22 are carried to the charge-contact portion N, which is a contact portion between the charge roller 21 and the photosensitive drum 1. At the charge-contact portion N, a large amount of the electroconductive particles 22 is taken from the photosensitive-drum surface by means of the charge roller 21, thus replenishing the charge roller 21 with the electroconductive particles 22.

A reference numeral 7 designates a process cartridge which is detachably mountable to a main body of the printer. The process cartridge 7 in this embodiment comprises three processing devices including the photosensitive drum 1, the charge roller 21 and the developing apparatus 3, which are integrally disposed in a cartridge detachably mountable to the printer main body. The combination of the process devices disposed in the process cartridge 7 is not limited to the above-described one.

(2) Charging Apparatus 2

Onto the surface of the charge roller 21 as a contact-type charging member, electroconductive particles 22 are preliminarily provided when the charging apparatus 2 is not yet used. Further, as described above, replenishment of the charge roller 21 with electroconductive particles 22 is performed via the peripheral surface of the photosensitive drum 1. The photosensitive drum 1 is charged in a state that the charge roller 21 carries thereon the electroconductive particles 22.

Further, by disposing the electroconductive particles 22 between the charge roller 21 (electroconductive elastic roller) and the photosensitive drum 1, it becomes possible to provide a speed difference between the charge roller 21 and the photosensitive drum 1, thus attaining a closer contact state therebetween. In other words, the electroconductive particles 22 contact the photosensitive-drum surface with no gap therebetween. The speed difference between the charge roller 21 and the photosensitive drum 1 is given by rotatably driving the charge roller 21 or by making the charge roller 21 non-rotational. The charge roller 21 may desirably be designed so that it is rotated in a counter direction relative to the surface moving direction of the photosensitive drum 1 as described above.

By using the above-described charging apparatus 2, it becomes possible to obtain higher charge efficiency that has not been accomplished by conventional roller charging, thus providing the photosensitive drum 1 as a member to be charged with a potential level substantially equal to the potential level of a voltage applied to the charge roller 21.

A bias voltage necessary for charging is sufficient if it has a value corresponding to a potential level required for the member to be charged. As a result, a stable and safe charging scheme is realized without using the discharge phenomenon.

a) Charging Roller 21

The charge roller 21 used in this embodiment is constituted of a metallic core 2*a*, and an intermediary resistance layer 2*b* composed of an elastic foamed material formed on the metallic core 2*a*.

The intermediary resistance layer 2*b* is composed of a resin or rubber functioning as a binder, electroconductive particles (e.g., carbon black), a foaming agent, and so forth, and is laid on the peripheral surface of the metallic core 2*a* to form a roller along with the metallic core 2*a*. After being laid on the metallic core 2*a*, the surface of the intermediary resistance layer 2*b* is polished, as desired, to prepare an electrically conductive elastic roller, as the charge roller 21, measuring 12 mm in diameter and 200 mm in longitudinal length.

The measured electrical resistance of the charge roller 21 in this embodiment was 100 k.ohm. More specifically, the resistance of the charge roller 21 was measured in the following manner. The charge roller 21 was placed in contact with an aluminum drum with a diameter of 30 mm, so that the metallic core 2*a* of the charge roller 21 was subjected to an overall load of 9.8N (1 kg), and then the resistance of the charge roller 21 was measured while applying a voltage of 100 V between the metallic core 2*a* and the aluminum drum.

In this embodiment, it is important that the charge roller 21 functions as an electrode. In other words, the charge roller 21 must be able to create a sufficient contact state with a member to be charged based on its elasticity, and the electrical resistance of the charge roller 21 is required to be sufficiently low to charge a moving member to be charged. On the other hand, it is necessary to prevent voltage from leaking through defective portions, such as pinholes, of a member to be charged, just in case such defects exist. Therefore, the electrical resistance of the charge roller 21 is desired to be in the range of $10^4$–$10^7$ ohm so that satisfactory charging performance and leak resistance are realized.

As for the hardness of the charge roller 21, if it is too low, the shape of the charge roller 21 becomes too unstable to maintain a desirable state of contact with the member to be charged. If it is too high, the charge roller 21 fails to form a desirable charging nip between itself and the member to be charged, and also the state of contact with the peripheral surface of the photosensitive drum 1 (member to be charged) within the charging nip becomes inferior at the microscopic level. Therefore, the desirable hardness range for the charge roller 21 is 20–50 deg. in the ASKER-C scale.

The material for the charge roller 21 may include a rubber or resin in which an electrically conductive substance, such as carbon black or metal oxide, are dispersed for adjusting an electrical resistance. It is also possible to adjust the electrical resistance by using an ion conductive material, instead of dispersing the electroconductive substance. Further, the electrical resistance can also be adjusted by mixing the metal oxide with the ion conductive material. In addition, the charge roller 21 is a foamed body. Therefore, a foaming agent and, e.g., a charge control agent, as desired, are added.

The charge roller 21 is effective in terms of production cost when it is formed in a single layer, but it is possible to further enhance its performance by forming the charge roller 21 in a multilayer construction comprising functionally separated layers.

b) Electrically Conductive Particles 22

In this embodiment, electrically conductive zinc-oxide particles having a specific resistance of $10^6$ ohm.cm and an average particle size of 1.2 $\mu$m are used as the electroconductive particles 22, and are uniformly coated with a brush on the peripheral surface of the charge roller 21 before use. Further, a predetermined amount of the electroconductive particles 22 are mixed by addition in the developer t of the developing apparatus 3.

As for the material for the electroconductive particles 22, various electroconductive particles can be used, such as those of an inorganic compound of, e.g., other metal oxides; mixtures of electroconductive particles with an organic compound; and those which have been surface-treated.

The specific resistance of the electroconductive particles 22 is desired to be not more than $10^{12}$ ohm.cm, and preferably not more than $1\times10^{10}$ ohm.cm, since electrical charge is given or received through the electroconductive particles 22.

The specific resistance of the charge roller 21 is obtained using a tabulating method. That is, first, a cylinder that measures 2.26 $cm^2$ in bottom-area size is prepared. Then, 0.5 g of a powdery sample is placed in the cylinder, between top and bottom electrodes, and the resistance of the sample is measured by applying 100 V between the top and bottom electrodes while compacting the sample between the top and bottom electrodes with a pressure of 147N (15 kg). Thereafter, the specific resistance of the sample is calculated from the result of the measurement through normalization.

In order to obtain a high charge efficiency and charge uniformity, the electroconductive particles 22 are desired to have an average particle size of not more than 10 $\mu$m, and preferably, not less than 0.1 $\mu$m.

When the electroconductive particles 22 are in the form of agglomerated particles, the particle size of the agglomerated particles is defined as the average particle size of agglomerated electroconductive particles.

For measurement of the particle size of the electroconductive particles 22, first, 100 or more particles are picked with the use of an electron microscope, and their maximum chord lengths in a horizontal direction are measured. Then, a volumetric particle distribution is calculated from the result of measurement. Based on this distribution, a 50% average particle size is calculated to be used as the average particle size of the electroconductive particles 22.

As described above, the electroconductive particles 22 may be in a state of not only primary particles but also secondary particles of agglomerated electroconductive particles. Neither state creates a problem. Whether the electroconductive particles 22 are in the primary particle state or the secondary particle state does not matter as long as they can function as electroconductive particles 22 for charging.

The electroconductive particles 22 for charging are desired to be white particles or closer to transparent particles so that they do not become an obstruction for an exposure beam for forming a latent image, particularly in the case of being used for charging a photosensitive drum 1. Further, in consideration of a partial transfer of the electroconductive particles 22 from the photosensitive-drum surface to the recording medium, the electroconductive particles 22 may desirably be colorless or white in color recording. Further, in order to prevent an imagewise exposure beam from being scattered by the electroconductive particles 22 for charging while the photosensitive drum 1 is exposed, the particle size of the electroconductive particles 22 is desired to be not more than a picture-element size, preferably smaller than an average particle size of the toner t. The lower limit of the particle size of the electroconductive particles 22 is considered to be 10 nm in view of stability of the electroconductive particles 22.

(3) Measure for Prevention of Falling of Electroconductive Particles 22 out of Charge Roller 21

The electroconductive particles 22 on the charge roller 21 gradually fall out, but in this embodiment, as described above, the charge roller 21 is replenished with electroconductive particles 22 from the developing apparatus 3 via the peripheral surface of the photosensitive drum 1, thus maintaining the direct charge-injection state.

However, with the use of the image forming apparatus, the falling (detachment) amount of the electroconductive particles 22 falling from the peripheral surface of the charge roller 21 and the replenishing amount of the electroconductive particle 22 replenished from the developing apparatus 3 to the charge roller 21 via the peripheral surface of the photosensitive drum 1 become out of a balance, thus resulting in an insufficient amount of electroconductive particles 22 required for adequate charging on the charge roller 21 in some cases. In such cases, charge performance is lowered to cause image failure. This phenomenon is liable to occur by the use of the image forming apparatus for a long period of time.

In this embodiment, in order to solve the problem, the peripheral surface of the photosensitive drum 1 is designed to be triboelectrically charged to have a polarity (positive in this embodiment) opposite from the charging polarity (negative in this embodiment) of a voltage for charging in the contact-charging portion N between the charge roller 21 and the photosensitive drum 1 as a member to be charged, on the assumption that the charge roller 21 and the photosensitive drum 1 contact each other with no electroconductive particles 22 disposed therebetween. Further, in the contact-charging portion N, the electroconductive particles 22 are designed to be triboelectrically charged to have a polarity (positive in this embodiment) opposite from the charging polarity (negative in this embodiment) of the voltage applied to the charge roller 21.

By setting the triboelectrically charging polarities of the charge roller 21, the photosensitive drum 1 and the electroconductive particles 22 as mentioned above, the electroconductive particles 22 are liable to be electrically attached to the charge roller 21 rather than the photosensitive drum 1. Accordingly, it is possible to enhance the tendency for the electroconductive particles 22 to remain on the peripheral surface of the charge roller 21, thus suppressing the detachment phenomenon of the electroconductive particles 22 detaching from the charge roller surface. Particularly, as in this embodiment, it becomes possible to stably maintain the direct charge-injection performance even when a cleanerless image forming apparatus is used for a long period of time and the peripheral surface of the charge roller 21 is liable to be in a state soiled with transfer residual toner that functions as a charge-inhibition factor.

Hereinbelow, specific embodiments of the charge roller 21 used in the present invention will be described in detail.

Embodiment 1

In this embodiment, a charge roller 21 was comprised of a foamed sponge roller using a silicone rubber as a principal raw material for a binder of the elastic layer **2*b***. In order to adjust the electrical resistance, approximately 10 wt. % of carbon black was added into the silicone rubber.

Embodiment 2

In this embodiment, a charge roller 21 was comprised of a foamed sponge roller using EPDM as a principal raw material for a binder of an elastic layer **2*b*. The elastic layer 2*b*** was formed by first adding approximately 15 wt. % of carbon black in EPDM and adding approximately 10 wt. % of a foaming agent for causing foaming at the time of vulcanization, followed by vulcanization and polishing.

Embodiment 3

In this embodiment, a charge roller 21 was prepared by coating a surface layer comprising a tetrafluoroethylene resin (Teflon: trade name) dispersed therein. Specifically, the coating was performed by spray coating so as not to impair the porous structure of a sponge-surfaced roller. The coating liquid used for the spray coating was prepared by dispersing Teflon particles and electroconductive tin oxide particles at a weight percentage ratio of approximately 60:40 in an aqueous acrylic resin liquid. The electroconductive particles (tin oxide particles) are added in an amount larger than the Teflon particles but at the peripheral surface of the charge roller 21, the Teflon occupied a larger proportion than the tin oxide since the Teflon had a smaller specific gravity than the tin oxide.

Embodiment 4

In this embodiment, as a charge roller 21, a charge roller coated with a polyethylene-based material at its surface by spray coating similarly as in Embodiment 3.

Embodiment 5

In this embodiment, as a charge roller 21, a foamed sponge roller having an elastic layer 2*b* comprising an ester-based urethane resin as a principal raw material for a binder therefor, and approximately 20 wt. % of carbon black added in the urethane resin as an electroconductive agent, was used.

Comparative Embodiment 1

As a comparative Embodiment, a foamed sponge roller comprising a foamed sponge roller of an ether-based urethane resin as a principal raw material, and approximately 10 wt. % of carbon black as an electroconductive agent, was used as a charge roller 21.

Each of the charge rollers 21 prepared in the above-described Embodiments (Embodiments 1–5 and Comparative Embodiment 1) at least has an outermost surface portion comprising the above-mentioned material, and each elastic layer 2*b* causes no problem if it fulfills the above-described basic properties as the charge roller 21.

In each of the above-described Embodiments, the electrical resistance of each charge roller 21 is adjusted in the range of $1\times10^{5}$–$1\times10^{6}$ ohm, which causes no problem at all in the initial charging performance as the charge roller 21.

By using the above-prepared charge rollers 21 with a photosensitive drum 1, a triboelectric charging state between each charge roller 21 and the photosensitive drum 1 can be confirmed through measurement in the following manner.

With respect to a charge roller 21 at an initial stage or after use, it is possible to confirm a charging state by friction between the charge roller 21 and a photosensitive drum 1 by first creating a state that electroconductive particles 22 are not attached to the charge roller 21 by effecting cleaning or polishing to the charge-roller surface, and then causing the charge-roller surface to contact the photosensitive-drum surface (in this case, the charge roller 21 is repetitively rotated by the photosensitive drum 1), followed by measurement of a change in the surface-potential level of the photosensitive drum 1 caused by the friction between the charge roller 21 and the photosensitive drum 1.

Figure 3:
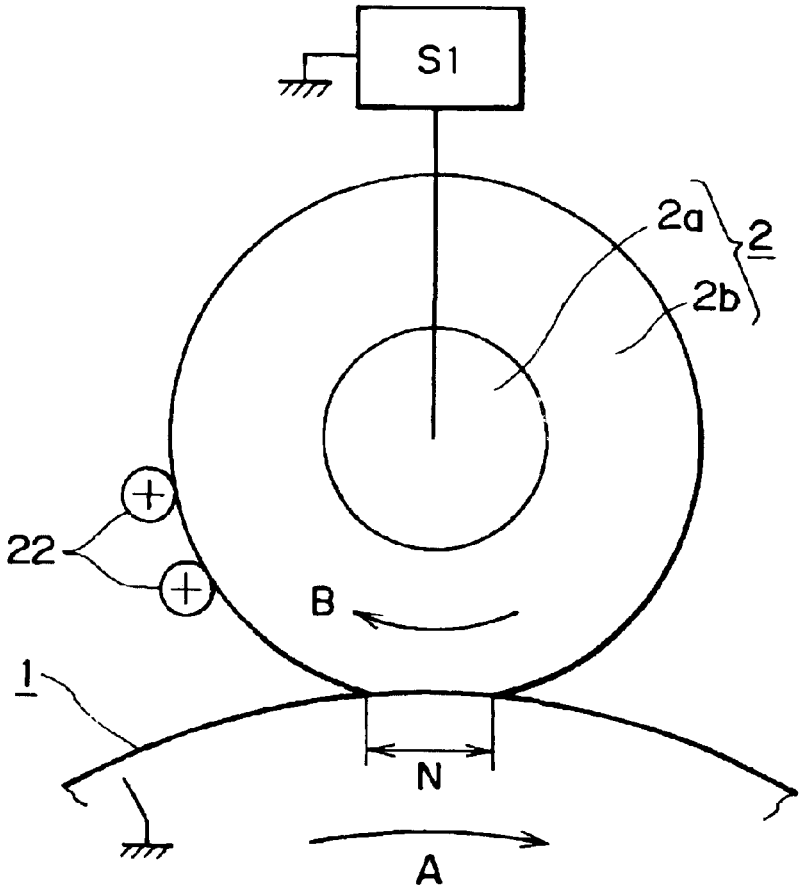
FIG. 3 is a schematic section of a charging apparatus for explaining a function thereof.

In these embodiments, in the case where the peripheral surface of the charge roller 21 as a contact-type charging member and that of the photosensitive drum 1 as a member to be charged directly contact each other with no electroconductive particles 22 interposed therebetween, the photosensitive-drum surface is triboelectrically charged to a polarity (positive in this case) opposite from the charging polarity (negative in this case) of the charge-roller surface. As a result, the surface-potential level of the photosensitive drum 1 is on the positive (+) side in comparison with that of the charge roller 21. In addition, the electroconductive particles 22 have a positive polarity, so that as specifically shown in FIG. 3, the positively charged electroconductive particles 22 are always liable to be electrostatically attached to the charge roller side. This is specifically because, in Embodiment 1, in the case where a voltage applied to the charge roller 21 is −700 V, the surface potential of the photosensitive drum 1 is −640 V, and thus the photosensitive-drum surface is consequently triboelectrically charged to +60 V relative to the charge roller 21.

Incidentally, in the above case, if the charging of the photosensitive drum 1 is performed only by the voltage applied to the charge roller 21, i.e., with no triboelectric charge therebetween, the photosensitive-drum surface is substantially charged to −700 V.

However, in an actual operating state of an image forming apparatus, the triboelectric charge is performed by not only the contact of the charge roller 21 with the photosensitive drum 1 but also the contacts of, e.g., the electroconductive particles 22 with the photosensitive drum 1 and the toner t with the photosensitive drum 1. Therefore, the average potential level by triboelectric charge becomes a different value from the above-described one. However, with respect to a triboelectric charge relationship among the charge roller 21, the photosensitive drum 1, and the electroconductive particles 22 in a minute region, the electroconductive particles 22 have a low electrical resistance, thus resulting in a phenomenon such that the triboelectric charge between the charge roller 21 and the photosensitive drum 1 is dominant. In other words, the triboelectric charge-potential level obtained through the above-described measurement becomes a measure of the phenomenon.

Further, with the use of the image forming apparatus for a long period, the toner t remaining on the photosensitive-drum surface after transfer is also attached to the charge-roller surface. However, the toner t has a larger charging electrical charge, than the electroconductive particles 22, thus readily having a predetermined electrical charge (negative in polarity in this case) which is to be essentially possessed by the toner t. As a result, the toner t is discharged from the charging-contact portion N (the charge roller 21) to the photosensitive drum 1. Further, the triboelectric charge from the toner t to the photosensitive drum 1 acts on the photosensitive drum 1 so that the photosensitive drum 1 is positively charged, thus promoting retention of the electroconductive particles 22 on the peripheral surface of the charge roller 21.

As the effect of the present invention, the amount of the electroconductive particles 22 present at the peripheral surface of the charge roller 21 as the contact-type charging member becomes excessive in some cases. However, in such cases, an electrostatically repulsive force is exerted between electroconductive particles 22, so that the excessive electroconductive particles 22 are gradually discharged from the peripheral surface of the charge roller 21 to that of the photosensitive drum 1. Therefore, on the peripheral surface of the photosensitive drum 1, a desirable necessary amount of the electroconductive particles 22 is always present on the charge roller surface.

Evaluation of Charging Performance

The charging performance of the charge rollers 21 prepared in the Embodiments 1–5 and the Comparative Embodiment 1 described above was evaluated to determine whether a streak defect is recognized or not on an image pattern consisting of a halftone image portion except for a forward end portion comprising a solid black image at the entire forward end portion, indicating that toner particles are completely attached but range over a region so that its longitudinal length (along the photosensitive-drum rotational direction) is shorter than the entire circumferential length of the photosensitive drum 1.

In order to strictly evaluate the charging performance, the image pattern had a printing proportion higher than 7%, which was a severe condition as a test pattern for a cleanerless-type printer and the printing proportion of the image pattern showed no difference in a longitudinal direction of the image pattern. The printing test was performed by using the image pattern.

The evaluation was performed based on the following criteria and the results are shown in Table 1 appearing hereinafter.

NG: Black streaks as an image-failure portion are visible in the entire areas with the halftone image.

F: Black streaks are somewhat visible in a ghost region corresponding to the areas with the halftone image immediately after the areas with the solid black image formed during the preceding rotation of the photosensitive drum.

G: The halftone image is uniform and good.

The printer for the charging-performance evaluation is of the reversal-development type. Accordingly, herein, the term "ghost" refers to a phenomenon in which a ghost image of a strongly developed preceding image pattern is created, since the areas corresponding to an image-exposure portion (i.e., toner-image portion) in the preceding rotation of the photosensitive drum caused charging failure (insufficient charging) during the following rotation of the photosensitive drum, and are thus strongly developed into an image with the preceding pattern on the photosensitive drum. The thus-obtained image is referred herein to as a ghost image, and a region in which the ghost image is created is referred to as a ghost region.

The charging-failure phenomenon is liable to be observed at the ghost region. Accordingly, the ghost region is used for evaluation of the charging performance.

The relationship between the triboelectric charge-potential values on the peripheral surface of the photosensitive drum and the resultant charging performances as to printing on predetermined numbers of sheets of the image pattern are shown in Table 1 below.

TABLE 1

| | Triboelectric | Charging performance | | |
|---|---|---|---|---|
| Embodiment | charge potential | 500 sheets | 2000 sheets | 4000 sheets |
| 1 | +60 V | G | G | G |
| 2 | +15 V | G | G | G |
| 3 | +40 V | G | G | G |
| 4 | +30 V | G | G | G |
| 5 | +5 V | G | G | F |
| Comparative 1 | −60 V | G | NG | NG |

In Embodiments 1–4, the respective charge rollers 21 have different structures but the photosensitive drum 1 is triboelectrically charged to have a surface-potential level of positive relative to that of the charge rollers 21. Therefore, the electroconductive particles 22 for charging are stably retained on the peripheral surface of the charge rollers 21, whereby good charging performance is attained even after the printing on a large number of sheets.

In Embodiment 5, the triboelectric charge potential is positive but its absolute value is low, so that the retention ability of the electroconductive particles for charging is lower than those in the case of Embodiments 1–4. As a result, when the printer for evaluation is used for a long period of time (printing on 4000 sheets), the charging performance is gradually lowered.

In Comparative Embodiment 1, the photosensitive-drum surface is triboelectrically charged to have a negative polarity, thus lowering the retention ability of the electroconductive particles 22 although the charging performance as to printing on an initial 500 sheets is at a level at which no problem occurs. More specifically, thereafter, the charging performance is abruptly lowered and at the time of printing on 2000 sheets, is too insufficient.

Miscellaneous

1) The shape of the contact-type charging member 21 does not need to be limited to the aforementioned roller form. It is also possible to use contact-type charging members which are different in form and/or material from the charge roller 21 described above, and for example, a fur brush, or a piece of felt or the like cloth, may be employed. Further, these materials and forms may be used in various combinations to realize better elasticity (flexibility) and electrical conductivity. A fur brush-type charge roller, the surface of which is covered with pile formed of strands of elastic fiber, may also be employed. More specifically, first, 3 mm-long strands of elastic fiber with an adjusted electrical resistance (Rec of UNICHIKA, or the like) are piled at a density of 155/mm$^2$, and then, the peripheral surface of a metallic core with a diameter of 6 mm, for example, is covered with the pile.

2) The choice of the means for exposing the surface of an image bearing member 1 to form an electrostatic latent image does not need to be limited to the laser-scanning digital-exposing means 6 described in the preceding embodiments. It may be an ordinary analog exposing means, a light emitting element such as an LED, or a combination of a light emitting element, such as a fluorescent light and a liquid crystal shutter. In other words, it does not matter as long as it can form an electrostatic latent image corresponding to the optical information of a target image.

3) An image bearing member as a member to be charged may be constituted of a dielectric member with an electrostatic recording faculty. In the case of such a dielectric member, the surface of the dielectric member is uniformly charged to a predetermined polarity and a predetermined potential level (primary charge), and then, the charge given to the surface of the dielectric member is selectively removed with the use of a charge-removing means, such as a charge-removing needle head or an electron gun to write, or form, the electrostatic latent image of a target image on the surface.

4) The developing apparatus 3 used in the preceding embodiments is of a reversal-development type using a monocomponent magnetic toner t. However, the structure of the developing apparatus does not need to be limited to the reversal-developing apparatus. It may be a normal developing apparatus.

The developing method for developing an electrostatic latent image may include ordinary developing schemes, which are roughly classified into the following four schemes:

a) a monocomponent non-contact developing scheme wherein an electrostatic latent image is developed on an image bearing member by coating a toner on a developer-carrying (conveying) member, such as sleeve, by means of a blade, and so forth (in the case of a non-magnetic toner) or a magnetic force (in the case of a magnetic toner), and then by causing the toner to act on the image bearing member in a non-contact state;

b) a monocomponent contact-developing scheme wherein the toner coating on the developer-carrying member as described in a) is caused to act on the image bearing member in a contact state to develop an electrostatic latent image;

c) a two-component, contact-developing scheme wherein an electrostatic latent image is developed on the image bearing member by carrying a mixture of toner particles with a magnetic carrier and a developer (two-component developer) and causing the developer to act on the image bearing member in a contact state; and d) a two-component non-contact developing scheme wherein the above two component developer is caused to act on the image bearing member to develop an electrostatic latent image.

5) The transfer apparatus 4 is not restricted to one using a roller. It may be those using a belt or corona discharge. The transfer apparatus 4 may be an intermediate transfer member, such as a transfer drum or a transfer belt, thus constituting an image forming apparatus allowing formation of not only a monochromatic image but also a multi- or full-color image through, e.g., a multiple transfer scheme.

6) The direct charge-injection operation uses a charging mechanism in which an electrical charge is directly moved from the contact-type charging member to a portion of the member to be charged. Therefore, the contact-type charging member is desired to intimately contact the surface of the member to be charged and is desired to be rotated to create a peripheral speed difference with the member to be charged. More specifically, the peripheral speed difference between the contact-type charging member and the member to be charged is given by driving the contact-type charging member while moving its peripheral surface. More preferably, the contact-type charging member is rotationally driven so that the rotational direction thereof is a counter direction relative to the moving direction of the member to be charged.

It is feasible to create the peripheral speed difference by moving the peripheral surfaces of both the contact-type charging member and the member to be charged, in the same direction. However, the effectiveness of the charge injection is dependent upon the ratio between the peripheral speeds of the charging member and the member to be charged, and in order to create, while moving the two surfaces in the same direction, a peripheral speed difference equal to the peripheral speed difference created by moving the two surfaces in the counter directions relative to each other, the number of revolutions of the contact-type charging roller must be rather drastically increased compared to when the two surfaces are moved in the different direction. Therefore, moving the two surfaces in the counter directions relative to each other is advantageous in terms of the number of revolutions of the contact-type charging roller. The peripheral speed difference, here, is defined as follows:

Peripheral speed difference (%)={(peripheral speed of contact-type charging member—peripheral speed of member to be charged)/peripheral speed of member to be charged}×100

In the above formula, the value of the peripheral speed of the contact-type charging member is positive when the peripheral surfaces of the contact-type charging member and the member to be charged are moved in the same direction.

7) The waveform of an alternating voltage component (AC component in which the voltage value periodically changes) of a bias applied to the developer-carrying member of the developing apparatus is optional; the alternating wave may be in the form of a sine wave, a rectangular wave, a triangular wave, or the like. Also, the alternating current may be constituted of an alternating current in the rectangular form which is generated by periodically turning on and off a DC power source.

8) The charging apparatus 2 of the present invention does not need to be used as the charging means for charging the image bearing member 1. The charging apparatus 2 can also be effectively be widely used as the charging means for charging various members to be charged.

As described hereinabove, according to the present invention, in the direct charge-injection-type charging apparatus using electroconductive particles for charging and in the image forming apparatus using the charging apparatus as charging means for charging the image bearing member (member to be charged), the member to be charged is designed to have a charge polarity obtained through only the triboelectric charge between the contact-type charging member and the member to be charged so that the charge polarity is opposite from the polarity of the electroconductive particles for charging. As a result, the charging electroconductive particles are caused to readily remain on the peripheral surface of the contact-type charging member, thus effectively providing a stable charging performance even when, e.g., a cleanerless-type image forming apparatus is used for a long period of time.

What is claimed is:

1. A charging apparatus comprising:

a charging member configured and positioned to charge a member to be charged while forming a nip with the member to be charged, and electroconductive particles disposed in the nip, wherein a voltage of a predetermined polarity is receivable by said charging member, wherein a surface of the member to be charged is triboelectrically charged by a surface of said charging member so as to have a polarity opposite from that of the voltage, and wherein said electroconductive particles are triboelectrically charged in the nip so as to have a polarity opposite from that of the voltage.

2. An apparatus according to claim 1, wherein said electroconductive particles have a volume resistivity of not more than $1\times10^{12}$ ohm.cm.

3. An apparatus according to claim 1, wherein said electroconductive particles have a volume resistivity of not more than $1\times10^{10}$ ohm.cm.

4. An apparatus according to claim 1, wherein an image is formed on the member to be charged with a toner, and wherein said electroconductive particles have an average particle size smaller than that of the toner.

5. An apparatus according to claim 1, wherein the member to be charged has a surface layer having a volume resistivity of not more than $1\times10^{14}$ ohm.cm.

6. An apparatus according to claim 1, wherein the member to be charged has a surface layer having a volume resistivity of $1\times10^{9}$–$1\times10^{14}$ ohm.cm.

7. An apparatus according to claim 1, wherein said charging member is moved to provide a difference in peripheral speed with the member to be charged in the nip.

8. An apparatus according to claim 1, wherein said charging member is rotated in such a direction as to provide counter-directional movement relative to the member to be charged in the nip.

9. An apparatus according to claim 1, wherein said charging member has an elastic layer at its surface.

10. An apparatus according to claim 1, wherein said charging member has an elastic foam layer at its surface.

11. An apparatus according to claim 1, wherein said charging member has a roller shape.

12. A process cartridge detachably mountable to a main body of an image forming apparatus, comprising:

a member to be charged capable of carrying an image;

a charging member configured and positioned to charge said member to be charged while forming a nip with said member to be charged; and electroconductive particles disposed in the nip, wherein a voltage of a predetermined polarity is receivable by said charging member, wherein a surface of said member to be charged is triboelectrically charged by a surface of said charging member so as to have a polarity opposite from that of the voltage, and wherein said electroconductive particles are triboelectrically charged in the nip so as to have a polarity opposite from that of the voltage.

13. A cartridge according to claim 12, wherein said electroconductive particles have a volume resistivity of not more than $1\times10^{12}$ ohm.cm.

14. A cartridge according to claim 12, wherein said electroconductive particles have a volume resistivity of not more than $1\times10^{10}$ ohm.cm.

15. A cartridge according to claim 12, wherein an image is formed on said member to be charged with a toner, and wherein said electroconductive particles have an average particle size smaller than that of the toner.

16. A cartridge according to claim 12, wherein said member to be charged has a surface layer having a volume resistivity of not more than $1\times10^{14}$ ohm.cm.

17. A cartridge according to claim 12, wherein said member to be charged has a surface layer having a volume resistivity of $1\times10^{9}$–$1\times10^{14}$ ohm.cm.

18. A cartridge according to claim 12, wherein said charging member is moved to provide a difference in peripheral speed with said member to be charged in the nip.

19. A cartridge according to claim 12, wherein said charging member is rotated in such a direction as to provide counter-directional movement relative to said member to be charged in the nip.

20. A cartridge according to claim 12, wherein said charging member has an elastic layer at its surface.

21. A cartridge according to claim 12, wherein said charging member has an elastic foam layer at its surface.

22. A cartridge according to claim 12, wherein said charging member has a roller shape.

23. A cartridge according to claim 16 or 17, wherein said member to be charged further comprises a photosensitive layer disposed inside the surface layer.

24. A cartridge according to claim 12, wherein an image is formed on said member to be charged with a toner, and wherein said electroconductive particles are triboelectrically charged by the toner so as to have a polarity opposite from that of the voltage.

25. A cartridge according to claim 12, wherein an electrostatic image is formed on said member to be charged and developed with a toner, and the polarity of the voltage is identical to a normal charging polarity of the toner.

26. An image forming apparatus comprising:

a member to be charged;

a charging member for charging said member to be charged while forming a nip with said member to be charged;

electroconductive particles disposed in the nip; and an image forming device configured and positioned to form an image on said member to be charged, wherein a voltage of a predetermined polarity is receivable by said charging member, wherein a surface of said member to be charged is triboelectrically charged by a surface of said charging member so as to have a polarity opposite from that of the voltage, and wherein said electroconductive particles are triboelectrically charged in the nip so as to have a polarity opposite from that of the voltage.

* * * * *

UNITED STATES PATENT AND TRADEMARK OFFICE

CERTIFICATE OF CORRECTION

PATENT NO. : 6,832,062 B2
DATED : December 14, 2004
INVENTOR(S) : Ishiyama et al.

It is certified that error appears in the above-identified patent and that said Letters Patent is hereby corrected as shown below:

Column 1,
Line 22, “6,128,456:” should read -- 6,128,456; --.

Column 6,
Line 53, “member 1.” should read -- member 1). --.
Line 57, “is” should read -- are --.

Column 9,
Line 35, “matter” should read -- matter, --.

Column 14,
Line 34, “element” should read -- element, --.

Column 15,
Line 13, “two component” should read -- two-component --.

Column 16,
Line 7, “be” (first occurrence) should be deleted.
Line 29, “charged,” should read -- charged; --.

Signed and Sealed this

Twenty-fourth Day of May, 2005

JON W. DUDAS
*Director of the United States Patent and Trademark Office*